US009265370B2

(12) United States Patent
Kellow, Jr.

(10) Patent No.: US 9,265,370 B2
(45) Date of Patent: Feb. 23, 2016

(54) COMBINATION FOOD AND BEVERAGE SERVING PLATE

(71) Applicant: Bethrick, Inc., Slinger, WI (US)

(72) Inventor: Richard A. Kellow, Jr., Slinger, WI (US)

(73) Assignee: Bethrick, Inc., Slinger, WI (US)

( * ) Notice: Subject to any disclaimer, the term of this patent is extended or adjusted under 35 U.S.C. 154(b) by 0 days.

(21) Appl. No.: 14/324,637

(22) Filed: Jul. 7, 2014

(65) Prior Publication Data

US 2015/0008231 A1 Jan. 8, 2015

Related U.S. Application Data

(60) Provisional application No. 61/843,884, filed on Jul. 8, 2013.

(51) Int. Cl.

| | |
|---|---|
| ***A47G 19/06*** | (2006.01) |
| ***B65D 21/02*** | (2006.01) |
| ***A47G 19/02*** | (2006.01) |

(52) U.S. Cl.

CPC ..... *A47G 19/065* (2013.01); *B65D 21/0216* (2013.01); *B65D 21/0233* (2013.01)

(58) Field of Classification Search

CPC ... A47G 19/065; A47G 19/022; A47G 19/06; A47G 19/23; B65D 21/0233

USPC ..... 220/694, 703, 500, 553, 574, 575, 220/23.83, 23.86, 23.87, 23.89, 669; 206/507, 505, 504, 503, 520, 519, 518, 206/516, 515

See application file for complete search history.

(56) References Cited

U.S. PATENT DOCUMENTS

| | | | |
|---|---|---|---|
| 2,427,697 | A | 9/1947 | Weidler |
| D190,668 | S | 6/1961 | Bliss |
| 3,955,672 | A | 5/1976 | Brundage |
| 4,346,070 | A | 8/1982 | Johnson |
| 4,461,396 | A | 7/1984 | Harper |
| D286,250 | S | 10/1986 | Prescott |
| D303,194 | S | 9/1989 | Darby et al. |
| D304,658 | S | 11/1989 | Mattei |

(Continued)

OTHER PUBLICATIONS

U.S. Notice of Allowance, U.S. Appl. No. 29/485,016, 10 pages (Jul. 6, 2015).

(Continued)

*Primary Examiner* — Robert J Hicks
*Assistant Examiner* — Kareen Thomas
(74) *Attorney, Agent, or Firm* — Foley & Lardner LLP

(57) ABSTRACT

A combination food and beverage serving plate includes an annular surface defining a predominately flat surface; a centrally located cylinder member surrounded by the annular surface and interconnected with the annular surface, the cylinder member including a top cavity for receiving a beverage container; and an annular perimeter wall surrounding the annular perimeter surface and interconnected with the annular surface. The annular perimeter wall forms an outer first boundary for the annular surface while the cylinder member forms an inner second boundary for the annular surface. Moreover, the top cavity is tapered, such that a diameter of the top cavity is larger near a top surface of the cylinder member than near an interior bottom surface of the cylinder member. As such, the top cavity is structured to receive beverage containers of various sizes and shapes.

1 Claim, 10 Drawing Sheets

(56) References Cited

U.S. PATENT DOCUMENTS

| | | | | |
|---|---|---|---|---|
| 4,938,373 | A * | 7/1990 | McKee | 220/23.86 |
| 5,058,737 | A | 10/1991 | Patterson et al. | |
| D331,860 | S | 12/1992 | Stanfield | |
| 5,184,750 | A | 2/1993 | Moller | |
| 5,184,751 | A | 2/1993 | Middleton | |
| 5,207,743 | A | 5/1993 | Costarella et al. | |
| 5,249,700 | A | 10/1993 | Dumke | |
| D342,190 | S | 12/1993 | Devitt | |
| D356,010 | S | 3/1995 | McEntee | |
| D360,112 | S | 7/1995 | McEntee | |
| 5,441,164 | A | 8/1995 | Beck et al. | |
| 5,551,593 | A | 9/1996 | Wiens | |
| 5,593,062 | A * | 1/1997 | Martin | A47G 19/065 220/556 |
| 5,695,052 | A | 12/1997 | Damato | |
| D398,481 | S | 9/1998 | Brown et al. | |
| 5,803,305 | A | 9/1998 | Perlis et al. | |
| D404,612 | S | 1/1999 | Blazevich | |
| 5,960,982 | A | 10/1999 | Perlis et al. | |
| 6,062,418 | A | 5/2000 | Rathjen | |
| 6,129,235 | A | 10/2000 | Creske | |
| D444,676 | S | 7/2001 | Murphy | |
| D453,308 | S | 2/2002 | McCauley | |
| 6,516,747 | B1 | 2/2003 | Willinger | |
| 6,550,630 | B1 | 4/2003 | Krupa | |
| 6,691,890 | B1 | 2/2004 | Persson | |
| D502,058 | S | 2/2005 | Stilz | |
| D509,994 | S | 9/2005 | Hadland | |
| D511,273 | S | 11/2005 | Hadeler | |
| D516,867 | S | 3/2006 | Martin et al. | |
| D523,185 | S | 6/2006 | Oliphant | |
| D526,536 | S | 8/2006 | Littlejohn et al. | |
| D527,224 | S | 8/2006 | Roth et al. | |
| D527,952 | S | 9/2006 | Roth et al. | |
| D527,954 | S | 9/2006 | Roth | |
| D560,044 | S | 1/2008 | Roes | |
| D568,112 | S | 5/2008 | Epstein | |
| D574,180 | S | 8/2008 | Broom | |
| D576,448 | S | 9/2008 | Harris | |
| D579,274 | S | 10/2008 | Bizzell | |
| D582,102 | S | 12/2008 | Roes | |
| D592,017 | S | 5/2009 | Bizzell | |
| D593,364 | S | 6/2009 | Harris | |
| D597,261 | S | 7/2009 | Dye et al. | |
| D623,806 | S | 9/2010 | Modi et al. | |
| 7,992,740 | B2 | 8/2011 | Kinchen | |
| D654,230 | S | 2/2012 | Tedaldi et al. | |
| D682,037 | S | 5/2013 | Cloutier | |
| D691,857 | S | 10/2013 | Muspratt-Williams et al. | |
| 8,672,175 | B2 | 3/2014 | Farmer | |
| D704,512 | S | 5/2014 | Kellow, Jr. | |
| D716,003 | S | 10/2014 | Brown | |
| 9,060,628 | B2 | 6/2015 | Evans | |
| 2003/0098310 | A1 | 5/2003 | McGee | |
| 2008/0156811 | A1 | 7/2008 | Lu et al. | |
| 2008/0173652 | A1 * | 7/2008 | Chou | 220/592.17 |
| 2009/0194543 | A1 | 8/2009 | Farmer | |
| 2013/0313264 | A1 * | 11/2013 | Dawson | A47G 19/06 220/574 |
| 2014/0367392 | A1 | 12/2014 | McClinton | |
| 2015/0008231 | A1 | 1/2015 | Kellow, Jr. | |

OTHER PUBLICATIONS

U.S. Office Action, U.S. Appl. No. 29/527,145, 6 pages (Aug. 26, 2015).

Notice of Allowance on U.S. Appl. No. 29/468,184 Dated Jan. 28, 2014, 7 pages.

* cited by examiner

COMBINATION FOOD AND BEVERAGE SERVING PLATE

CROSS-REFERENCE TO RELATED APPLICATION

This application claims the benefit of U.S. Provisional Patent Application No. 61/843,884, filed Jul. 8, 2013, which is incorporated herein by reference in its entirety.

BACKGROUND

Food plates, beverage cups, and utensils are commonly used when consuming food and beverages. Over time, food plates and beverage containers have evolved to encompass a variety of different shapes and sizes. For example, food plates have been developed with dividers/compartments designed to keep food items separate. Even with these developments, from private (e.g., in-home) to public use (e.g., out-of-home such as, a dinner party, a restaurant, a bar, etc.), it is common for people to carry a food plate and a beverage container simultaneously. However, simultaneous carrying can prove challenging when trying to avoid spills and conduct other activities (e.g., shaking hands, using utensils, etc.). This challenge is also encountered by restaurant servers who routinely carry many food items and beverage containers.

SUMMARY

One embodiment relates to a combination food and beverage serving plate. The combination food and beverage serving plate includes an annular surface defining a predominately flat surface; a centrally located cylinder member surrounded by the annular surface and interconnected with the annular surface, the cylinder member including a top cavity for receiving a beverage container; and an annular perimeter wall surrounding the annular perimeter surface and interconnected with the annular surface. The annular perimeter wall forms an outer first boundary for the annular surface while the cylinder member forms an inner second boundary for the annular surface. Moreover, the top cavity is tapered, such that a diameter of the top cavity is larger near a top surface of the cylinder member than near an interior bottom surface of the cylinder member. As such, the top cavity is structured to receive beverage containers of various sizes and shapes.

Another embodiment relates to a one-piece combination food and beverage serving plate. The one-piece combination food and beverage serving plate includes an annular surface defining a predominately flat surface; a centrally located cylinder member surrounded by the annular surface and interconnected with the annular surface, the cylinder member including a top cavity and a bottom external surface; an annular perimeter wall surrounding the annular perimeter surface and interconnected with the annular surface; and a bottom annular surface, the bottom annular surface located on an opposite side of the combination food and beverage serving plate relative to the annular surface. The bottom external surface is offset from the bottom annular surface at a height above the bottom annular surface, such that the plate rests substantially solely on the bottom annular surface when the plate is in an upright position.

Yet another embodiment relates to a combination food and beverage serving plate. The combination food and beverage serving plate includes an annular surface defining a predominately flat surface; a centrally located cylinder member surrounded by the annular surface and interconnected with the annular surface, the cylinder member including a top cavity and a bottom cavity; a bottom annular surface, the bottom annular surface located on an opposite side of the combination food and beverage serving plate relative to the annular surface; and a separator bar located on an interior bottom surface of the cylinder member in the bottom cavity. The separator bar is structured to reduce a contact area of the combination food and beverage serving plate with another combination food and beverage serving plate when the two plates are placed in a stacked configuration.

The described features, structures, advantages, and/or characteristics of the subject matter of the present disclosure may be combined in any suitable manner in one or more embodiments and/or implementations. In the following description, numerous specific details are provided to impart a thorough understanding of embodiments of the subject matter of the present disclosure. One skilled in the relevant art will recognize that the subject matter of the present disclosure may be practiced without one or more of the specific features, details, components, materials, and/or methods of a particular embodiment or implementation. In other instances, additional features and advantages may be recognized in certain embodiments and/or implementations that may not be present in all embodiments or implementations. Further, in some instances, well-known structures, materials, or operations are not shown or described in detail to avoid obscuring aspects of the subject matter of the present disclosure. The features and advantages of the subject matter of the present disclosure will become more fully apparent from the following description and appended claims, or may be learned by the practice of the subject matter as set forth hereinafter.

DETAILED DESCRIPTION

Referring to the figures generally, a combination food and beverage serving plate is shown according to various embodiments herein. The combination food and beverage serving plate ("plate") is structured as a unitary (e.g., one-piece) component that allows a user to conveniently carry both a beverage container and one or more food items using only one hand. Generally speaking, the plate includes an annular base or surface surrounding a raised cylindrical member. The raised cylindrical member includes a top cavity that allows for reception of a beverage container while the annular base allows for reception of one or more food items. To substantially prevent the food items from falling off of the plate, the centrally located cylinder member and a perimeter wall form an inner and outer boundary for the items placed in the annular base area. On the bottom of the plate, an interior cylindrical cavity is formed by the cylindrical member and serves to accept a user's fingers. In this position, the plate is able to be held and manipulated using only one hand. Accordingly, the user is able to have a free hand with which to conduct other activities (e.g., shake hands, grab food items from the annular base, remove and place the beverage container back in the cylindrical cavity, grab a door knob, etc.) while holding the plate that simultaneously holds a beverage container and one or more food items.

Figure 10:
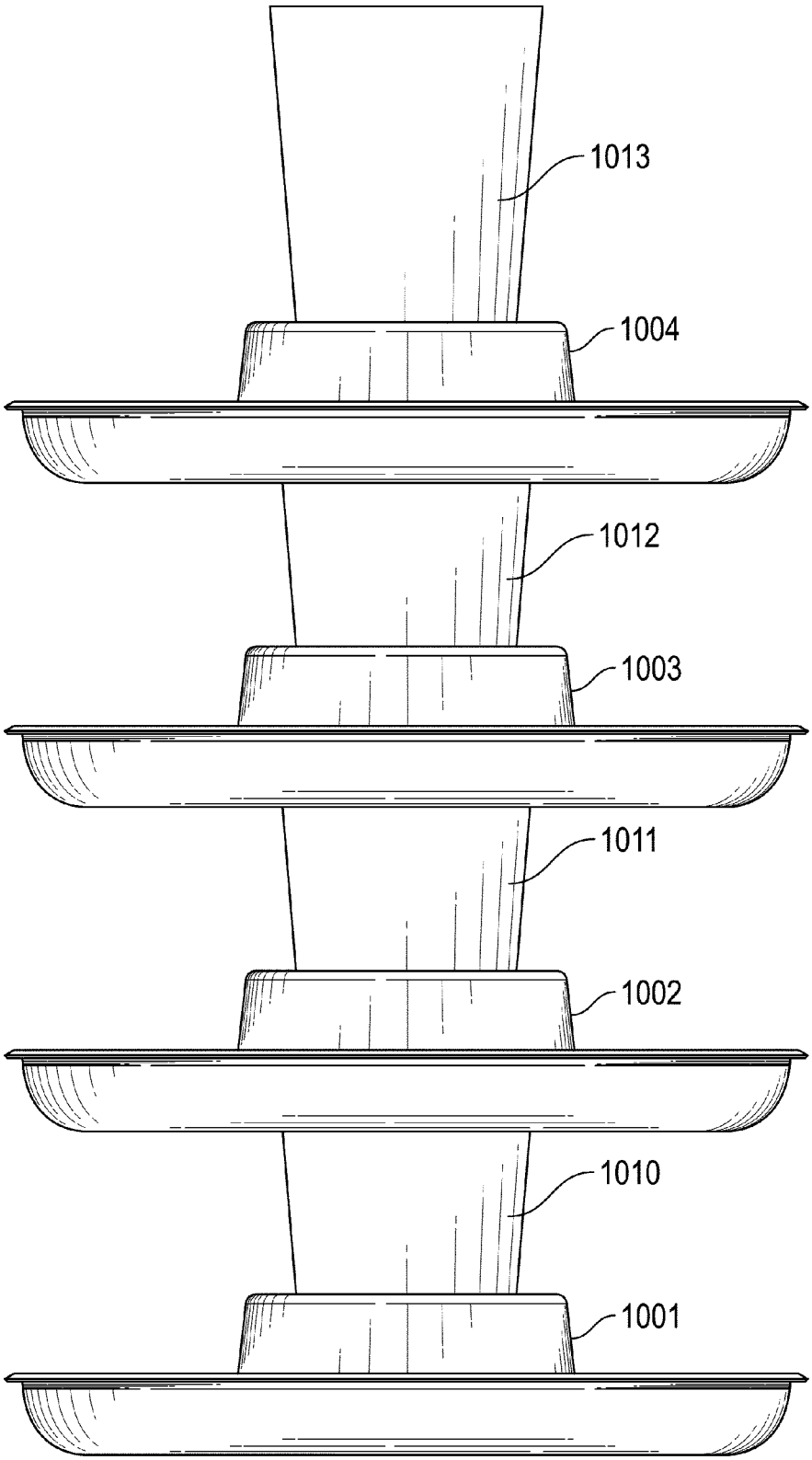
FIG. 10 is a diagram of a stacking configuration for a combination food and beverage serving plate using beverage containers as intermediaries, according to one embodiment.

As used herein, the term "beverage container" refers to a liquid holder. For example, a beverage container may be a pint glass, a twelve ounce can, a cup, etc. Accordingly, the term beverage container is meant to be broadly interpreted and not limiting, despite the Figures only depicting the "beverage container" as a beverage can (FIG. 8) and a pint glass (FIG. 10).

Figure 1:
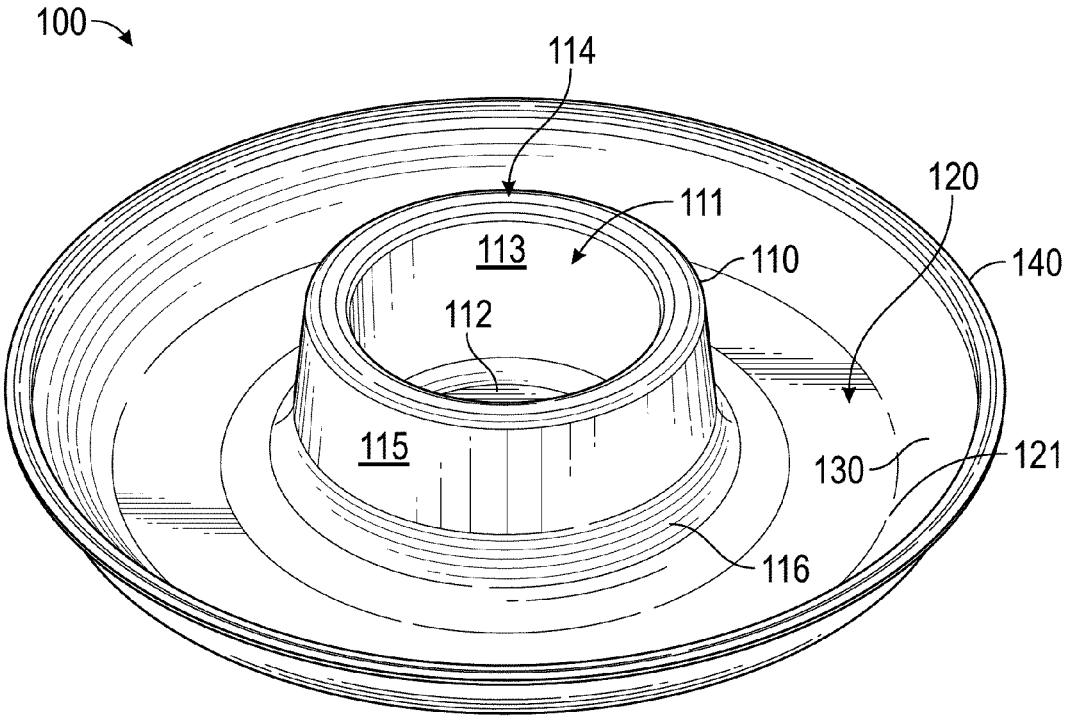
FIG. 1 is a top isometric view of a combination food and beverage serving plate, according to one embodiment.

Referring now to FIG. 1, a top isometric view of the combination food and beverage serving plate ("plate") 100 is shown according to one embodiment. As shown, the plate 100 is a unitary, one-piece, and continuous component. The plate 100 includes a centrally located cylinder member 110 interconnected to a predominately flat annular surface 120 that surrounds the cylinder member 110. The flat annular surface 120 is interconnected to an annular perimeter wall 130 that is interconnected to a lip 140. In the view depicted in FIG. 1, the plate 100 is in an upright position. The upright position refers to the cylinder member 110 facing upwards (e.g., towards the sky), such that a user may easily place a beverage container (or other item) in the cylinder member 110 and place other items on the annular surface 120.

As shown, the cylinder member 110 is centrally located on the plate 100 and forms an inner boundary for the annular surface 120. The cylinder member 110 is also shown to include a top cavity 111. The top cavity 111, or opening, is structured to allow the cylinder member 110 to receive and hold a beverage container (see, e.g., FIG. 8). The top cavity 111 includes a predominately flat interior bottom surface 112 for the beverage container to rest upon. When the beverage container is placed in the cavity 111, a top interior cylindrical surface 113 of the member 110 surrounds the beverage container. The top interior cylindrical surface 113 prevents or substantially prevents the beverage container from tipping or otherwise falling when placed in the cavity 111. The top interior cylindrical surface 113 is interconnected to the flat interior bottom surface 112 and top surface 114. The top surface 114 is interconnected to a top exterior cylindrical surface 115 of the cylinder member 110. The top exterior cylindrical surface 115 interconnects to the flat annular surface 120 via a fillet 116.

In one embodiment, the annular surface 120 is a predominately flat surface, such that it may provide an area for one or more food items (e.g., chicken wings, see FIG. 8) or other items to rest upon. While the cylinder member 110, via cavity 111, is structured to substantially hold and maintain the stability of a beverage container, the cylinder member 110 also acts as a divider between items placed in the cavity 111 and outside the cylinder member 110 (e.g., items that surround the cylinder member 110 on the annular surface 120). The annular perimeter wall 130 and cylinder member 110 form inner (the cylinder member 110) and outer (the perimeter wall 130) boundaries for the annular surface 120 to hold, stabilize, and substantially prevent the items placed on the area defined by the annular surface 120 from falling. More specifically, the top exterior cylindrical surface 115, the flat annular surface 120, and the annular perimeter wall 130 define a volume for holding food items on the plate 100 and substantially preventing the food items from falling off of the plate 100. The flat annular surface 120 is connected to the annular perimeter wall 130 via another fillet 121. At the top of the perimeter wall 130 is a lip 140. The lip 140 is structured to overhang the exterior perimeter surface 150 (see, e.g., FIG. 3) to allow a user of the plate 100 to firmly grab and hold the plate 100 (see FIGS. 9A-9D).

Figure 2:
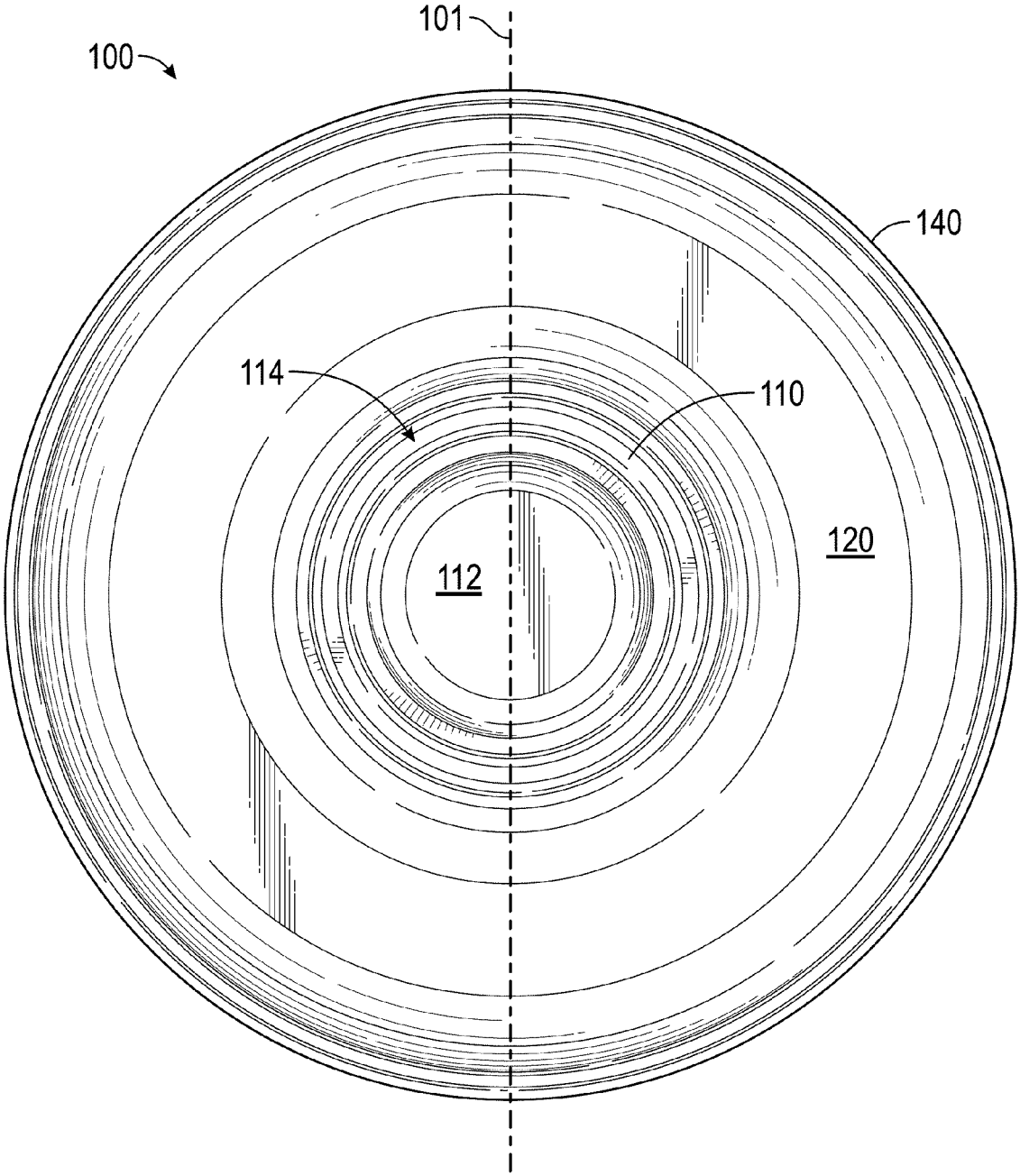
FIG. 2 is a top view of a combination food and beverage serving plate, according to one embodiment.

Referring now to FIG. 2, a top view of the plate 100 is shown, according to one embodiment. As shown, the plate 100 includes two predominately flat surfaces for receiving food items and/or a beverage container: the interior bottom surface 112 and the annular surface 120. In the example of FIG. 2, the plate 100 is circular-shaped and, therefore, symmetrical about a central axis 101. According to an alternate embodiment, the plate 100 may be square, rectangular, oval, or any other shape. In these alternate embodiments, the central cylinder member may be shaped to coincide with the overall shape (e.g., a square-column shaped central member for a square-shaped plate, etc.). Furthermore, in other alternate embodiments, the central member (i.e., cylinder member 110) may be offset from the center of the overall plate. This configuration may be utilized to accommodate items that take up a relatively larger volume (e.g., a chicken breast). In the example embodiments shown and described herein, the raised member is centrally located such that the plate is not unbalanced.

Figure 3:
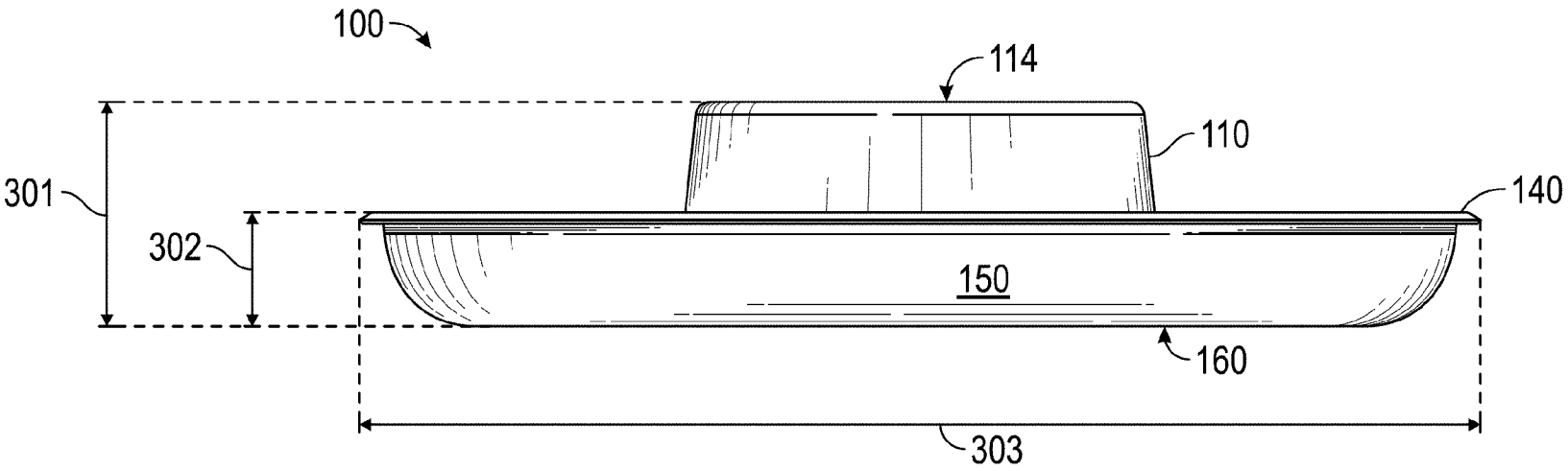
FIG. 3 is a side view of a combination food and beverage serving plate, according to one embodiment.

Referring to FIG. 3, a side view of the plate 100 in the upright position is shown, according to one embodiment. The side view of the plate 100 depicts the exterior perimeter surface 150 of the annular perimeter wall 130. The side view of the plate 100 also depicts the relative sizes of the features of the plate 100. As mentioned above, in one configuration, the plate is circular-shaped with a diameter 303. In one embodiment, the diameter 303 of the plate 100 is approximately ten inches, where approximately refers to plus-or-minus one inch. Using the bottom annular surface 160 as a datum reference, the height 301 is the distance from the bottom annular surface 160 to the top of the cylinder member 110 (i.e., the top surface 114). The height 302 represents the distance between the top of the lip 140 and the bottom annular surface 160. According to one embodiment, the height 301 of the cylinder member 110 is approximately twice as tall as the height 302 of the perimeter wall 130. According to one embodiment, the height 301 is approximately equal to two inches while the height 302 is approximately equal to one inch, where approximately refers to plus-or-minus a half of an inch. According to an alternate embodiment, the height 301 is any distance greater than the height 302. Due to the relatively high walls of the cylinder member 110, the cylinder member 110 is able to prevent or substantially prevent tippage of the beverage container placed in the top cavity 111. According to one embodiment, the dimensions described above (e.g., diameter 303, height 302, and height 301) may be used with the dimensions of the plate 100 described in regard to FIG. 6.

Figure 4:
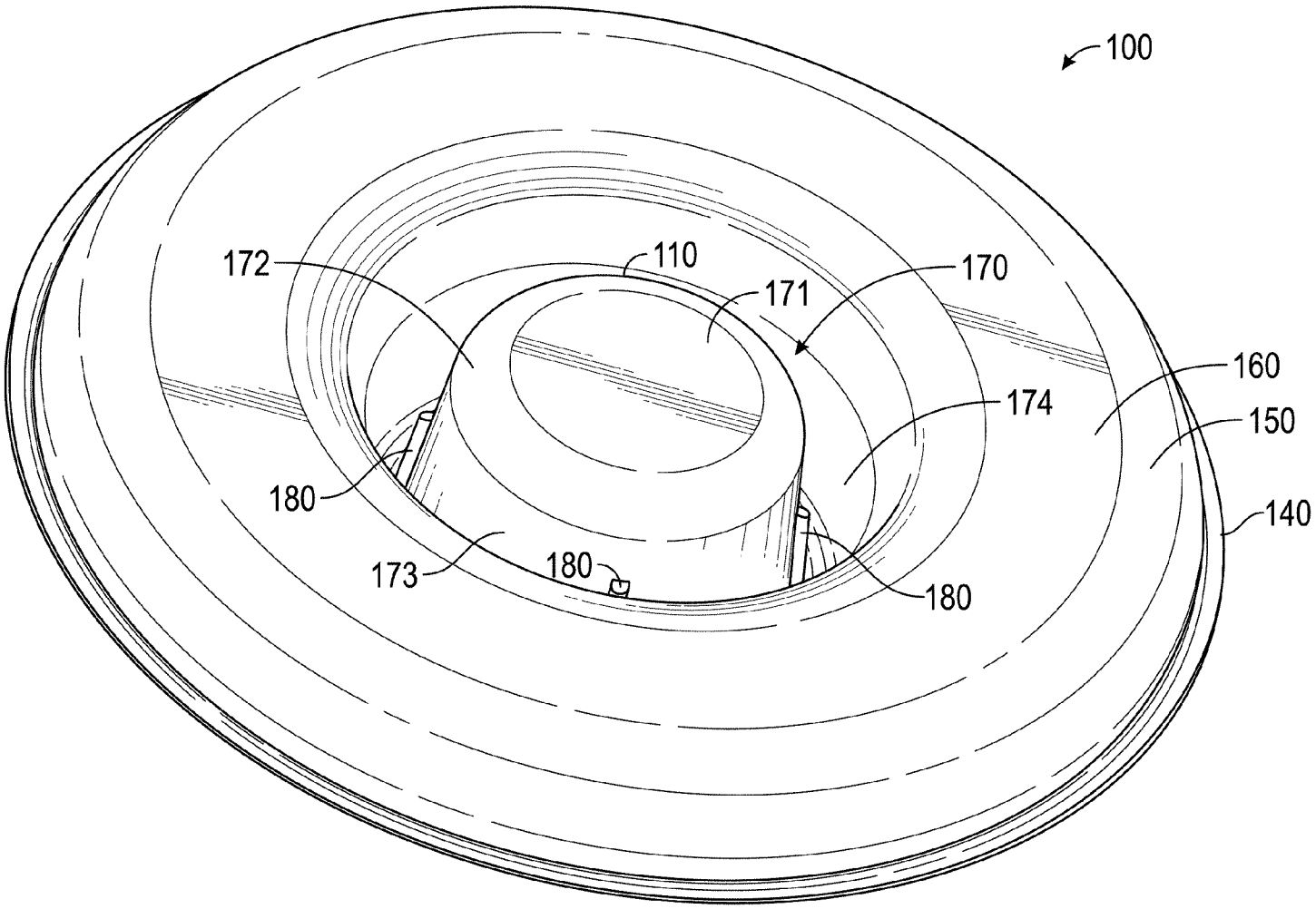
FIG. 4 is a bottom isometric view of a combination food and beverage serving plate, according to one embodiment.
Figure 5:
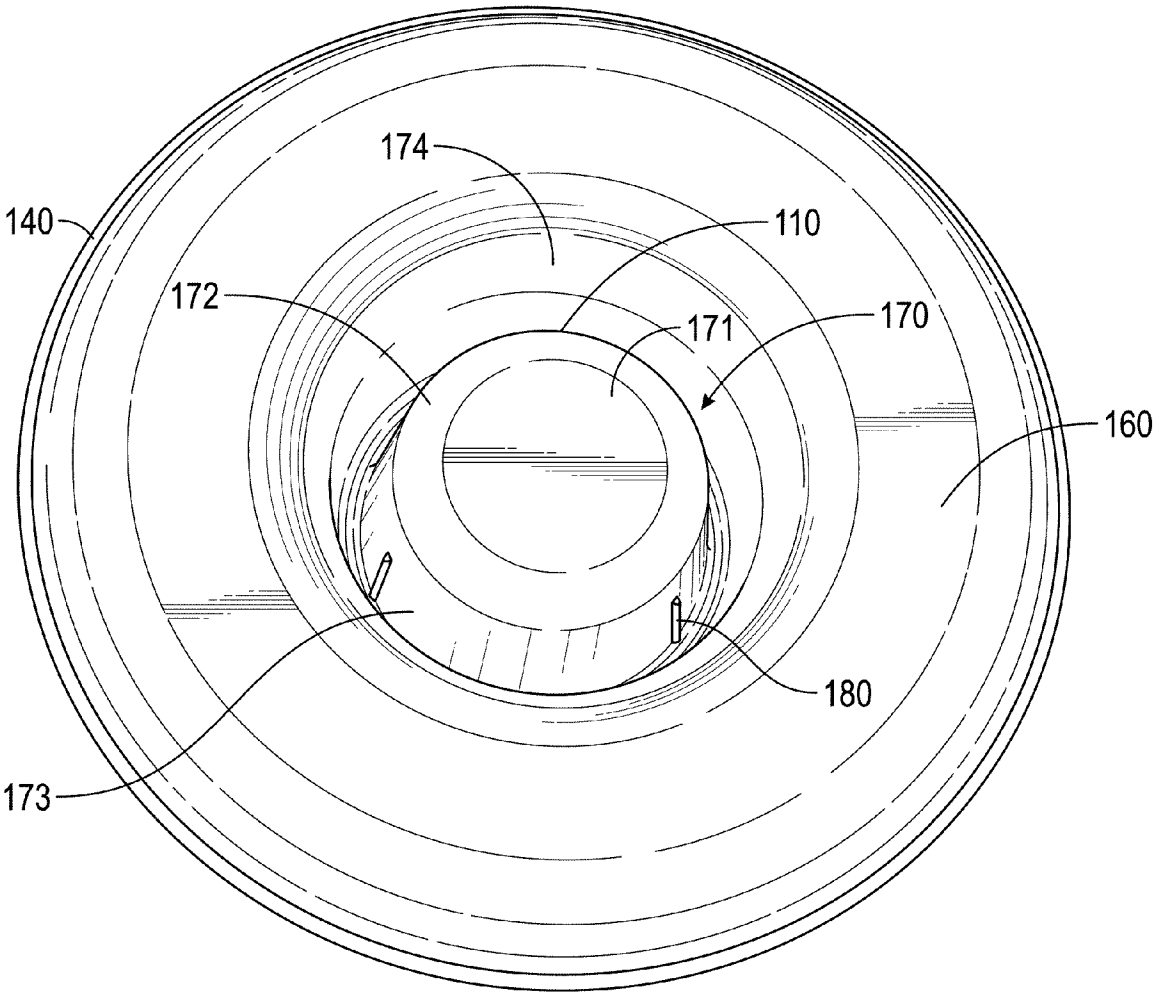
FIG. 5 is a bottom view of a combination food and beverage serving plate, according to one embodiment.

Referring to FIGS. 4-5 collectively, a bottom perspective view of the plate 100 (FIG. 4) and a bottom view of the plate 100 (FIG. 5) are shown, according to one embodiment. These views represent the opposite side of the plate 100 relative to the upright position shown in FIGS. 1-3. Among others, the bottom surfaces of the plate 100 include the exterior perimeter surface 150 and a bottom annular surface 160. The exterior perimeter surface 150 is interconnected to the bottom annular surface 160. In one embodiment, the interconnection is via a rounded edge. In other embodiments, the interconnection may be via a chamfer, corner, and the like. Because the views in FIGS. 4-5 represent the opposite side of the plate 100 relative to the upright position, the bottom annular surface 160 is the opposite side of the annular surface 120.

At the center of the plate 100, the bottom side of the cylinder member 110 forms a bottom cavity 170 relative to the bottom annular surface 160. A rounded edge may connect the bottom annular surface 160 to a first interior surface 174 of the bottom side of the cylinder member 110. As shown, the cylinder member 110 is hollow, such that the bottom cavity is a cylindrically shaped opening. Accordingly, the bottom side of the cylinder member 110 includes the first interior surface 174 interconnected to a second interior surface 173. Opposite of the interior bottom surface 112 (FIG. 1) is a bottom external surface 171 of the cylinder member 110. Although shown as circular-shaped, the bottom external surface 171 may include a variety of different shapes (e.g., square, rectangle, oval, etc.). Thus, the shape of the bottom external surface 171 may vary in accord with the shape of the central member. The bottom external surface 171 is interconnected to the second interior surface 173 via a round 172. In certain other embodiments, a corner, chamfer, or other type of connector may be used to join the second interior surface 173 and the bottom external surface 171.

Referring further to FIGS. 4-5, the bottom side of the cylinder member 110 is shown to include separator bars 180 located in the bottom cavity 170. As shown, the separator bars 180 are integral with the second interior surface 173. In some other embodiments, the separator bars 180 may be located on the first interior surface 174. As shown, three separator bars 180 are equally spaced about the bottom side of the cylinder member 110 (a fourth separator bar is not shown due to the angle of the view in FIG. 4). However, in other embodiments, many more (or less) separator bars may be used with the plate 100. Similarly, although the separator bars 180 are shown to be rectangularly-shaped, in other embodiments, the bars may be any shape and size that allows for stacking of the plates and reducing the friction between stacked plates to allow for a relatively easier un-stacking. The separator bars 180 may more fully be explained in connection with FIGS. 11A-11B.

Figure 11A:
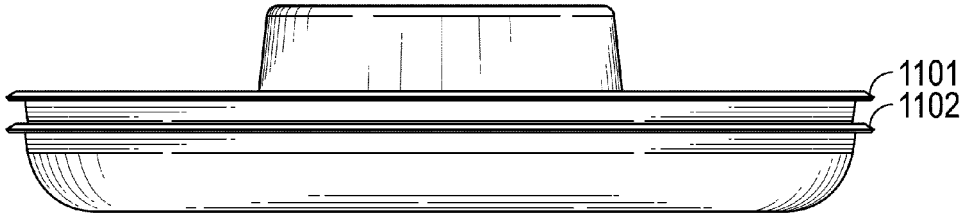
FIGS. 11A-11B are diagrams of stacking configurations for a combination food and beverage serving plate, according to one embodiment.
Figure 11B:
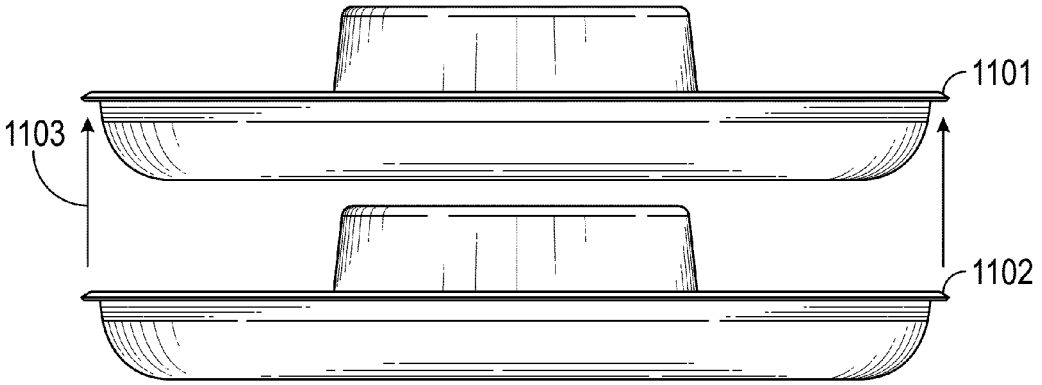

FIG. 11A shows an example stacking configuration of a top plate 1101 and a bottom plate 1102. The stacking ability of the plates saves space and provides for a neat organization method of the plates. Although the top plate 1101 and the bottom plate 1102 may have different reference numerals than that used herein, the top plate 1101 and the bottom plate 1102 have the same structure as the plate 100. As such, the features of the plate 100 described herein are used to explain the stacking configuration. Accordingly, to stack the top plate 1101 with the bottom plate 1102, the bottom cavity 170 of the top plate 1101 receives a cylinder member 110 of the bottom plate 1102. As shown, the plates 1101 and 1102 are placed into a stacked configuration when they are in the upright position. In FIG. 11B, the insertion direction 1103 of the bottom plate 1102 relative to the top plate 1101 is shown to explain the stacking of the plates in the upright position. However, this direction may be reversed when the top plate 1101 is placed on top of the bottom plate 1102 in a stacked configuration. During insertion and in the stacked configuration (FIG. 11A), the top exterior cylindrical surface 115 of the bottom plate 1102 is brought into contact or near contact with the first interior surface 174 of the top plate 1101. The top interior cylindrical surface 113 of the bottom plate 1102 is arranged to surround or substantially surround the second interior surface 173 of the top plate 1101. The separator bars 180 prevent or substantially prevent the top plate 1101 and the bottom plate 1102 from becoming stuck together. Accordingly, the separator bars 180 of the top plate 1101 contact the top interior cylindrical surface 113 of the bottom plate 1102. Therefore, the separator bars 180 prevent the top interior cylindrical surface 113 of the bottom plate 1102 from fully contacting the second interior surface 173 of the top plate 1101. Accordingly, an air gap is created between the top interior cylindrical surface 113 of the bottom plate 1102 and the second interior surface 173 of the top plate 1101. Because of the gap, the separator bars 180 reduce a contact area of a first plate to a second plate when the first and second plates are placed in the stacked configuration. As such, due to the relatively smaller contact area, a relatively smaller amount of friction is present in the stacked plates 1101 and 1102. As mentioned above, this enables a user to then easily un-stack the plates 1101 and 1102. Although only two plates are shown in FIGS. 11A-11B in a stacked arrangement, many more plates may be stacked.

Figure 6:
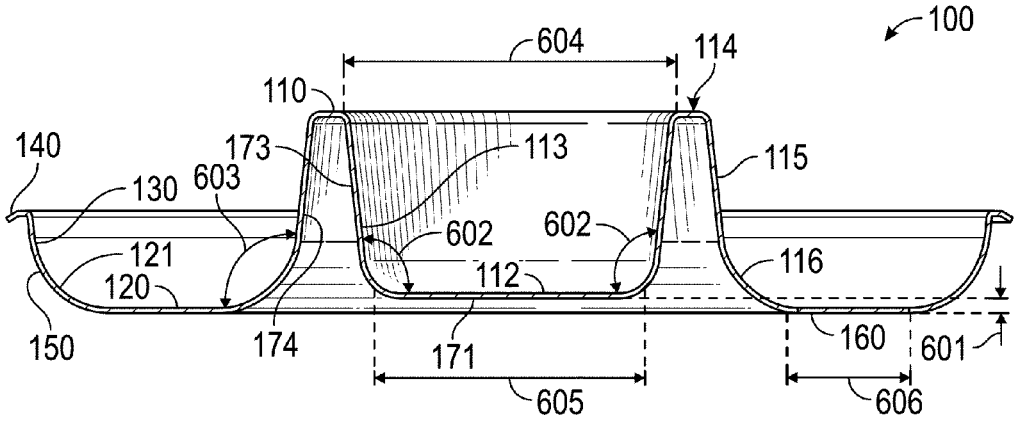
FIG. 6 is a cross-sectional view of a combination food and beverage serving plate, according to one embodiment.

Referring now to FIG. 6, a cross-sectional view of the plate 100 is shown, according to one embodiment. In this example, the cross-section is taken across the central axis line 101 (FIG. 2). As shown, the top cylindrical interior surface 113 is at an angle 602 with the interior bottom surface 112. The top cylindrical exterior surface 115 is at an angle 603 with the annular surface 120. According to one embodiment, the angles 602 and 603 are obtuse (i.e., greater than ninety-degrees), such that the top cavity 111 of the cylinder member 110 is tapered, with a diameter 604 being greater than a diameter 605. According to one embodiment, the angle 602 is ninety-six degrees while the angle 603 is also ninety-six degrees. According to other embodiments, the angles 602 and 603 are both obtuse, but differ in value (e.g., angle 602 is ninety-six degrees while angle 603 is one-hundred and thirty degrees). As mentioned above, the diameter 604 is greater than the diameter 605 due to the tapering. Accordingly, the diameter 604 is taken at or near the top surface 114 of the cylinder member 110 while the diameter 605 is taken at or near the interior bottom surface 112 of the cylinder member 110. Because of the tapering, the cavity 111 is able to receive a variety of different shaped beverage containers (e.g., a tapered pint glass, a completely cylindrical beverage can, etc.). According to one embodiment, the diameter 604 is approximately 3.175 inches while the diameter 605 is approximately 2.763 inches, where approximately refers to plus-or-minus 0.1 inches.

In one embodiment the radius of the fillet 116 is approximately 0.75 inches while the radius of the fillet 121 is approximately 0.75 inches, where approximately refers to plus-or-minus 0.1 inches. In this embodiment (as further defined in regard to FIG. 3 above), the width 606 of the annular surface 120 (and, in turn, the bottom annular surface 160) is approximately 1.10 inches, where approximately refers to plus-or-minus 0.1 inches. In this example, the width 606 is taken from the radius center point of the fillet 116 to the radius center point of the fillet 121.

Referring further to FIG. 6, the bottom external surface 171 is separated by a distance 601 above the bottom annular surface 160. By being offset, the plate 100 rests predominately solely on the bottom annular surface 160 when placed on a flat surface (e.g., a table). This structure functions to support the plate in a sturdy and stable manner. This structure may be used with relatively heavier beverage containers (e.g., a stein glass) in order to allow slight deformation (i.e., a compression of the distance 601) when the container is placed in the cavity 111. In turn, the plate 100 may still rest steadily on a flat surface despite some slight deformation in the cylinder member 110.

Figure 7:
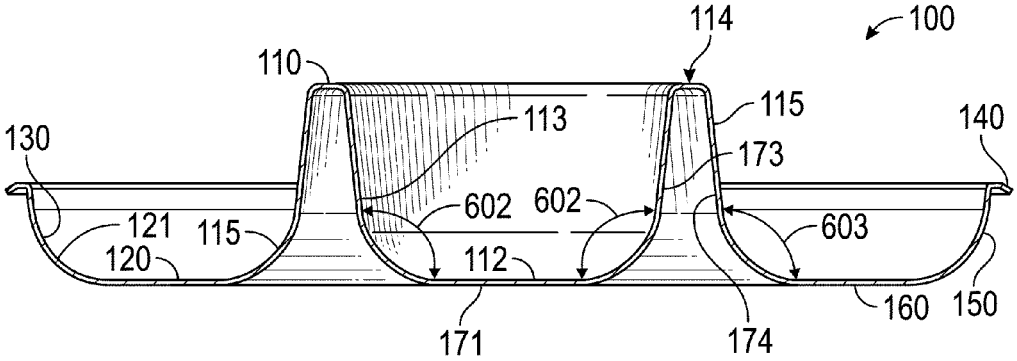
FIG. 7 is a cross-sectional view of a combination food and beverage serving plate, according to another embodiment.

Referring now to FIG. 7, an alternate embodiment of the structure of the cylinder member 110 is shown, according to one embodiment. In comparison to FIG. 6, the bottom external surface 171 is on or substantially on the same plane as the bottom annular surface 160. In this example, the plate 100 may rest on both the bottom external surface 171 and the bottom annular surface 160 when put on a flat surface, such as a table.

With the above description of the plate 100, applications and uses of the plate 100 may be shown in FIGS. 8-11B. FIGS. 11A-11B are described above in regard to FIGS. 4-5. These applications and uses are provided for exemplary purposes only, and are not meant to be limiting. Accordingly, various other uses and applications of the plate 100 may exist, such as: using the plate as a drink coaster when placed on a chair, sofa cushion or carpet; using the plate as a food service tray, using the plate as a food service tray with a cover or cap over the top cavity of the cylinder member; using the plate for feeding children; and using the plate for feeding animals or pets. The alternate embodiments may also have the object formed out of a low density product that enables it to float in water and keep the contents dry to due to its high perimeter side walls.

Figure 8:
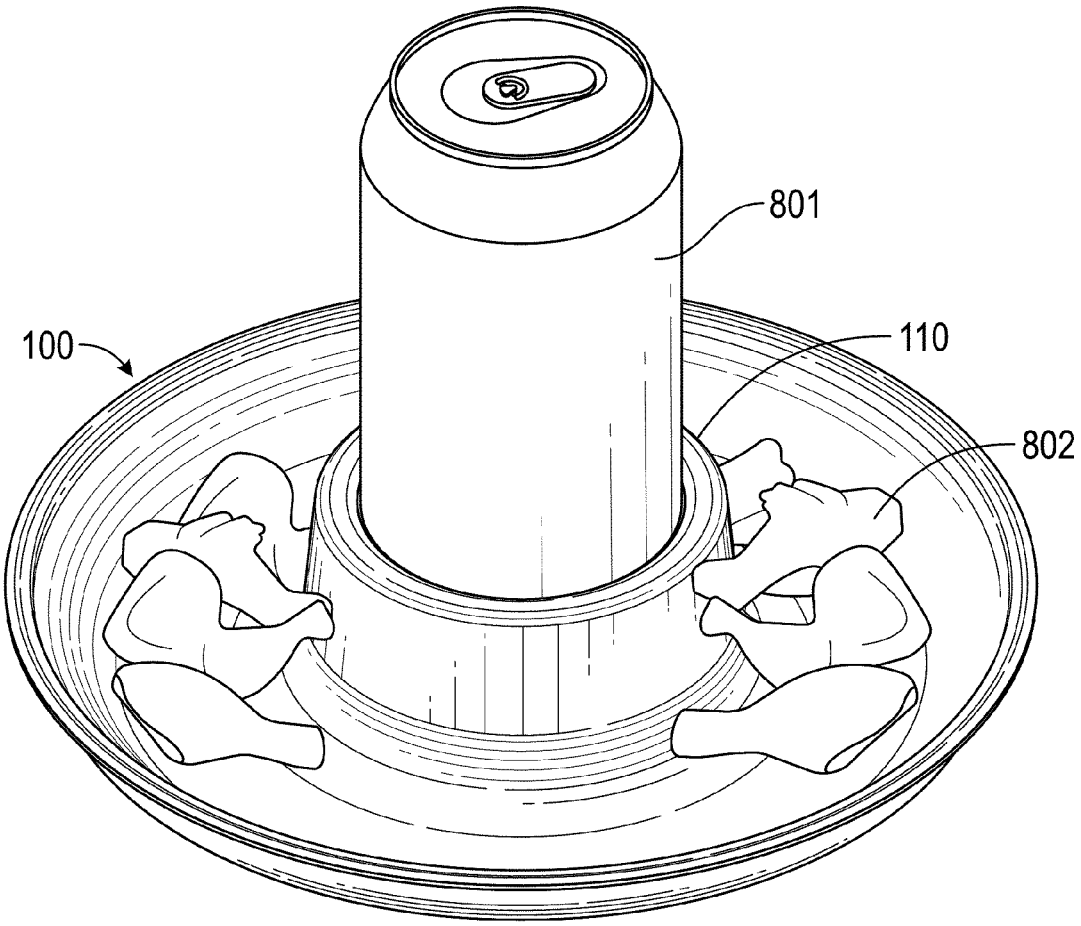
FIG. 8 is a serving configuration for a combination food and beverage serving plate, according one embodiment.

Referring to FIG. 8, a serving configuration of the plate is shown, according to one embodiment. As shown, the cylinder member 110 (via the cavity 111) receives a beverage container, shown as beverage can 801. The surrounding annular surface receives one or more food items, shown as chicken wings 802. In addition to stabilizing the can 801, the high walls of the cylinder 110 separate the beverage can 801 from the wings 802.

Figure 9A:
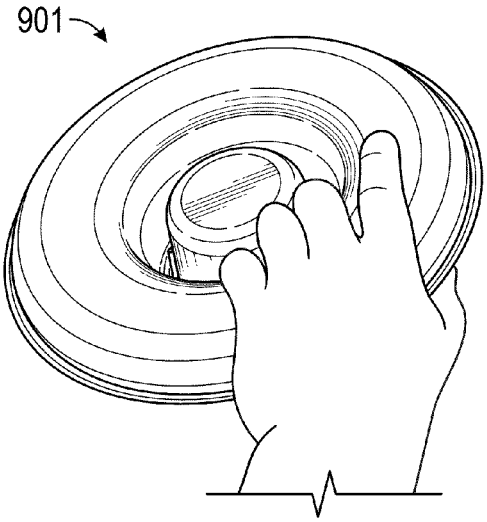
FIGS. 9A-9D are schematic diagrams of holding a combination food and beverage serving plate, according to several embodiments.
Figure 9B:
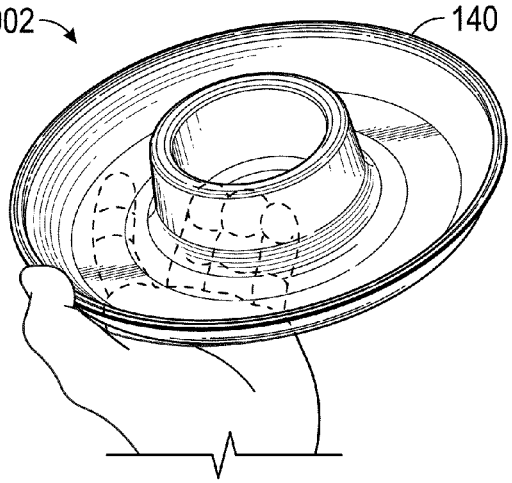
Figure 9C:
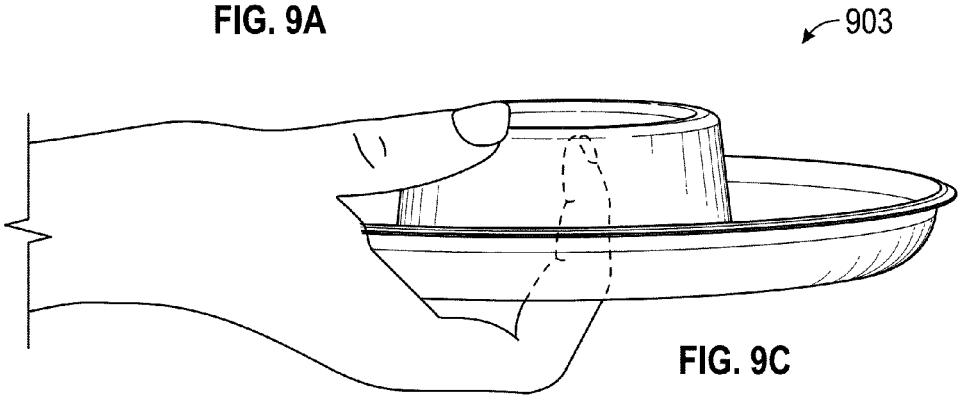
Figure 9D:
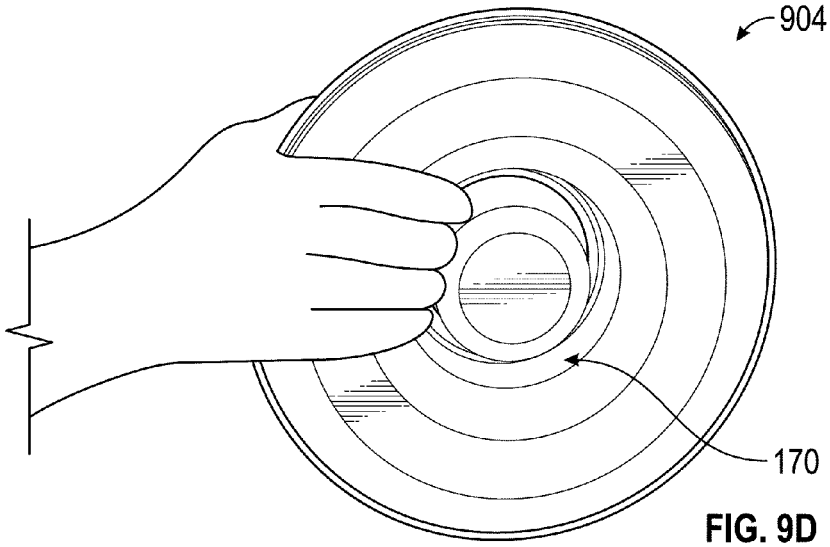

Referring to FIGS. 9A-9D, a schematic diagram of holding the plate is shown, according to several example embodiments. FIG. 9A shows a bottom isometric view 901, a top isometric view 902 (FIG. 9B), a side view 903 (FIG. 9C), and a bottom view 904 (FIG. 9D) of a user holding the plate 100. As shown, the plate 100 may be held by one hand of a user. One or more fingers of a user may wrap around the bottom surfaces of the plate into the bottom cavity 170 (views 901 and 904). Stabilization of the plate may then be accomplished from the palm and/or thumb of the user bracing the lip 140 (view 902). Allowing for one's fingers to reach into the bottom cavity 170 allows the user firmly hold the plate 100 in one hand. Accordingly, referring back to FIG. 8, a user may then simultaneously carry food items (chicken wings 802) and a beverage container (beverage can 801) using only one hand.

Accordingly, as shown in FIGS. 9A-9D, one method of holding the plate 100 is as follows. The combination food and beverage serving plate is grasped on the underside by either the right or left hand. The fingers curl naturally into the bottom cavity. The palm supports the majority of the weight of the plate while the thumb rests on the topside perimeter lip. The hand is largely relaxed and does not require gripping or a great deal of thumb pressure to maintain control. Food, snacks, or the like can be added topside into the dish portion, and the perimeter and interior walls serve to virtually eliminate spillage. A variety of drinking vessels can be placed into the top center cavity.

Referring to FIG. 10, an example stacking configuration of the plate is shown, according to one embodiment. As compared to FIGS. 11A-11B, FIG. 10 depicts a stacking arrangement utilizing beverage containers as intermediaries. The beverage containers of FIG. 10 are tapered from a relative narrower bottom to a relatively wider top. Accordingly, the beverage containers may be structured as a pint glass or another type of tapered beverage container. The tapered top cavity 111 of the cylinder member 110 allows for a smooth reception of the tapered beverage container. Because of the tapering of the top cavity 111 (and, therefore, bottom cavity 170) of the cylinder member 110, the bottom cavity 170 is also able to follow the angle of the taper of the beverage container, such that the beverage container is also smoothly received by the bottom cavity 170 of a plate 100.

Starting from the bottom (denoted by plate 1001 as compared to the top, which is represented by plate 1004), the first plate 1001 is holding a first beverage container 1010. The first beverage container 1010 is received by the bottom cavity 170 of the second plate 1002. Due to the interaction of the bottom cavity 170 with the beverage container 1010, the second plate 1002 is supported by the first beverage container 1010. The interaction may be more fully be explained as follows. The top of the beverage container is encompassed by the first and second interior surfaces 174 and 173 that define the bottom cavity 170. Because the cylinder member 110 is tall enough to prevent or substantially prevent tipping of the beverage container, the depth of the bottom cavity 170 allows the second plate 1002 (and plates 1003 and 1004) to rest on the beverage container with a substantial sturdiness and balance (i.e., the plate is level with minimal teetering). The second plate 1002 receives a second beverage container 1011. The second beverage container 1011 is received by a bottom cavity 170 of a third plate 1003. A top cavity 111 of the third plate 1003 receives a fourth beverage container 1012. A top of the fourth beverage container 1012 is received by a bottom cavity 170 of the fourth plate 1004. A top cavity 111 of the fourth plate 1004 is shown to receive a fourth beverage container 1013.

Despite only depicting four plates and four beverage containers, fewer or more plates and beverage containers may be utilized. As with FIGS. 11A-11B, the plates (e.g., 1001-1004) have the same structure as the plate 100, but utilize different reference numbers in order to explain the plate-to-beverage container-to-plate stacking configuration.

The present disclosure may be embodied in other specific forms without departing from its spirit or essential characteristics. The described embodiments are to be considered in all respects only as illustrative and not restrictive. The scope of the disclosure is, therefore, indicated by the appended claims rather than by the foregoing description. All changes which come within the meaning and range of equivalency of the claims are to be embraced within their scope.

Accordingly, the unitary body construction of the food and beverage plate is also not meant to be limiting, such that more than one component may be used to form the food and beverage plate while still staying within the spirit and scope of the disclosure. In the unitary body construction, the plate may be formed from a sheet of a plastic. The sheet of plastic may be formed using a process of thermo vacuum forming. Alternatively, a liquefied polymeric resin can be injection molded, cooled, and then trimmed as needed. Depending upon cost considerations, material properties of the plastic sheet or resin formulation can be altered to fit the requirements, including flexibility, strength, thermal stability, or chemical resistance. Furthermore, cost considerations or final desired result will dictate whether one of these two methods of manufacture is employed. In various alternate embodiments, the combination food and beverage serving plate may be constructed of wood, rubber, metal, composite, carbon fiber, Kevlar, paperboard, corrugated cardboard, cast iron, cast aluminum, or some combination of laminated wood fibers, fabrics, or other material that was then process hardened for properties in the preferred embodiment.

It is to be understood that the inventions disclosed herein are not limited to the details of construction and the arrangement of the components set forth in the description or illustrated in the drawings. The inventions are capable of other embodiments or being practiced or carried out in various ways. It is also to be understood that the phraseology and terminology employed herein is for the purpose of description and should not be regarded as limiting.

Also, the terms are intended to be broad terms and not terms of limitation. For purposes of this disclosure, the term "interconnected" shall mean the joining of two members directly or indirectly to one another. Such joining may be achieved with the two members or the two members and any additional intermediate members being integrally formed as a single unitary body with one another or with the two members or the two members and any additional intermediate member being attached to one another. Such joining may be permanent in nature or alternatively may be removable or releasable in nature.

It is also important to note that although only a few embodiments of the combination food and beverage serving have been described in detail in this disclosure, those skilled in the art who review this disclosure will readily appreciate that many modifications are possible (e.g., variations in sizes, dimensions, structures, shapes and proportions of the various elements, values of parameters, mounting arrangements, materials, colors, orientations, etc.) without materially departing from the novel teachings and advantages of the subject matter recited in the disclosed embodiments. Accordingly, all such modifications are intended to be included within the scope of the present disclosure as defined in the disclosed embodiments.

What is claimed:

1. A combination food and beverage serving plate, comprising:

an annular surface defining a predominately flat surface;

a centrally located cylinder member having a solid interior bottom surface, a top interior surface, and defining a bottom cavity, wherein the cylinder member is surrounded by the annular surface and interconnected with the annular surface, wherein the cylinder member defines a top cavity positioned opposite the bottom cavity, wherein the top cavity is sized to receive a beverage container, and wherein the solid interior bottom surface supports the beverage container and the top interior surface is adjacent a bottom portion of the beverage container when the beverage container is received in the top cavity to hold and substantially prevent;

an annular perimeter wall surrounding and interconnected with the annular surface;

a bottom annular surface located on an opposite side of the combination food and beverage serving plate relative to the annular surface;

a bottom external surface of the cylinder member located on an opposite side of the combination food and beverage serving plate relative to the solid interior bottom surface;

at least one separator bar positioned in the bottom cavity on the cylinder member, wherein the bottom cavity is sized to at least partly receive a cylinder member of another combination food and beverage serving plate when the two combination food and beverage serving plates are placed in a stacked configuration, and wherein the at least one separator bar is structured to contact the cylinder member of the another combination food and beverage serving plate to reduce a contact area of the combination food and beverage serving plate with the another combination food and beverage serving plate to reduce friction between the two combination food and beverage serving plates and substantially prevent the two combination food and beverage serving plates from sticking together in the stacked configuration; and a lip interconnected to the annular perimeter wall, wherein the lip is angled down toward a support surface for the combination food and beverage serving plate and away from the annular perimeter wall;

wherein the annular perimeter wall forms an outer first boundary for the annular surface;

wherein the cylinder member forms an inner second boundary for the annular surface; and wherein the top cavity is tapered, such that a diameter of the top cavity is larger near a top surface of the cylinder member than near the solid interior bottom surface of the cylinder member;

wherein the bottom external surface is offset from the bottom annular surface at a height above the bottom annular surface, such that the combination food and beverage serving plate rests substantially solely on the bottom annular surface when the combination food and beverage serving plate is in an upright position on the support surface;

wherein the cylinder member is approximately twice as tall as the annular perimeter wall;

wherein the combination food and beverage serving plate is a one-piece component; and wherein the combination food and beverage serving plate is circular-shaped, such that the combination food and beverage serving plate is symmetrical about a central axis.

* * * * *